United States Patent [19]

Maurer et al.

[11] Patent Number: 4,665,997

[45] Date of Patent: May 19, 1987

[54] PRESSURE BALANCED BEARING ASSEMBLY FOR DOWNHOLE MOTORS

[75] Inventors: William C. Maurer; William J. McDonald, both of Houston, Tex.

[73] Assignee: Maurer Engineering Inc., Houston, Tex.

[21] Appl. No.: 759,248

[22] Filed: Jul. 26, 1985

[51] Int. Cl.[4] ..... E21B 4/02

[52] U.S. Cl. ..... 175/107; 175/324; 415/107; 415/502

[58] Field of Search ..... 175/324, 107, 321; 415/502, 107, 104; 384/99, 613, 619

[56] References Cited

U.S. PATENT DOCUMENTS

| | | | |
|---|---|---|---|
| 3,014,542 | 12/1961 | Hildebrandt et al. | 175/107 |
| 3,054,595 | 9/1962 | Kaufmann | 415/107 |
| 3,058,510 | 10/1962 | Tiraspolsky et al. | 415/107 |
| 4,080,094 | 3/1978 | Jeter | 415/107 |
| 4,114,704 | 9/1978 | Maurer et al. | 175/107 |

FOREIGN PATENT DOCUMENTS

| | | | |
|---|---|---|---|
| 2059481 | 4/1981 | United Kingdom | 175/107 |
| 126076 | 3/1960 | U.S.S.R. | 175/107 |

*Primary Examiner*—James A. Leppink
*Assistant Examiner*—Hoang C. Dang
*Attorney, Agent, or Firm*—Neal J. Mosely

[57] ABSTRACT

A downhole motor and bearing assembly for high pressure operation has a tubular housing with an inlet and outlet for flow of drilling fluid. A stator is supported in the housing and a rotor is supported for rotary movement in the stator. An open tubular shaft is connected to the rotor for rotary movement in the housing. The bearing assembly has bearing members in the housing in fixed spaced relation for carrying downward and upward longitudinal thrust loads. Since the motor is designed for high pressure operation, conventional bearings tend to wear out rapidly. In this motor and bearing assembly, the pressure of drilling fluid passing through the motor is bled into the down hole side of the bearings where the pressure is applied against an upset on the bearings shaft having an exposed area on the lower side sufficient to produce an upward thrust partially or completely offsetting the downward thrust produced by the pressure drop across the drill bit. The pressure balanced bearing assembly is operable in combination with any motor operating on flow of fluid, including Moineau motors, turbodrills, etc.

33 Claims, 6 Drawing Figures

PRESSURE BALANCED BEARING ASSEMBLY FOR DOWNHOLE MOTORS

BACKGROUND OF THE INVENTION

1. Field of the Invention

This invention relates to new and useful improvements bearing assemblies for use on downhole motors and to motor-bearing assemblies.

2. Brief Description of the Prior Art

Drilling apparatus wherein a drill bit is operated by a downhole motor, such as positive displacement fluid motors or a turbine driven motors, are well known in the prior art. In such motors, the drill bit is rotated by a rotor being turned by flow of fluid, such as drilling fluid through the motor assembly.

In such downhole motor assemblies, bearings are provided which are sometimes part of the overall motor assembly and which are sometimes provided in a separate bearing pack or bearing assembly which is fastened or secured to the motor housing. The bearings support the drilling thrust on the shaft during the drilling operation. Other bearings transfer hydraulic thrust from the motor to the shaft when the motor is pulled from the bore hole or when the drill bit is lifted off bottom.

When a downhole motor is operating, there are two downward forces acting on the rotor shaft, viz., hydraulic downthrust and rotor weight, and one upward thrust, viz., bit weight (the reactive upward thrust resulting from the action of the drill against the earth formation). In normal drilling operations, it is often possible to adjust the bit weight so that it nearly balances the downward forces and thus unloads the bearings. This greatly extends the life of the conventional motor bearings. This is often done with large diameter turbodrills, e.g., 5–12 in. diameter, where the downward thrusts range from 10,000–30,000 pounds (150–1000 psi) and the rubber thrust bearings used in these turbodrills fail rapidly if nearly balanced bit weights are not used.

When downhole motors are designed for high pressure, high speed operation, e.g. 10,000 psi, the bearing life is less than 1.0 hour as compared to 200 hours at conventional low pressure operation. This rapid wearing out of bearings makes the development of high pressure, high speed downhole motor driven drills almost impossible. It is apparent that high pressure, high speed motors require the development of either higher capacity bearings or means for reducing the bearing load at high bit pressures.

The following patents illustrate some of the types of bearings which have been or are being used in downhole motors, none of which address the problem of high pressure operation:

Tschirky U.S. Pat. No. 3,879,094 discloses a downhole motor consisting of a positive displacement motor having a bearing assembly on the motor housing which has tungsten carbide radial bearings and a plurality of longitudinally spaced axial thrust bearings.

Tiraspolsky U.S. Pat. No. 3,449,030 discloses a bearing assembly for use in downhole motors which includes a plurality of spaced axial thrust bearings having woven wire annular pads which function to absorb shock.

Garrison U.S. Pat. No. 3,594,106 discloses a downhole motor assembly having a plurality of longitudinally spaced axial thrust bearings and a spring mechanism for absorbing shock.

Stodt U.S. Pat. No. 4,135,772 discloses a bearing assembly for a downhole motor driven drill having axially spaced ball bearings for carrying axial thrust loads and having springs interposed between the bearings for absorbing shock.

Crase U.S. Pat. No. 4,260,202 discloses a bearing assembly for downhole motors which includes spaced ball bearing assemblies which include springs for absorbing axial shock.

Winkelmann U.S. Pat. No. 4,388,973 discloses a bearing assembly for a downhole motor in which bearings are spaced by shoulders on a series of sleeves which form a continuous supporting tube on the inside and outside of the bearing structure and supported on the rotating motor shaft. These bearings include springs for absorbing axial shock loads but are not constructed for interchangeability of the positioning of the bearings for determining the amount of upward and downward thrust supported by the bearing assembly.

Maurer et al U.S. Pat. No. 4,114,704 discloses a turbodrill having means to use the pressure of drilling mud to reverse the application of bearing forces from the lower to the upper thrust bearings, but does not suggest any means for continuously unloading the lower thrust bearings continuously during motor operation.

SUMMARY OF THE INVENTION

It is therefore one object of this invention to provide a new and improved bearing assembly for use in combination with downhole motors for earth drilling.

Another object of this invention is to provide a new and improved bearing assembly for use in combination with downhole motors for operation under high pressure conditions.

Another object of this invention is to provide a new and improved bearing assembly for high pressure operation in a downhole motor which includes means to unload the bearings to increase bearing wear life.

Still another object of this invention is to provide a bearing assembly for use in connection with downhole motors for high pressure, high speed operation in which the pressure of the fluid operating the motor is applied to unload the bearings to increase wear life.

Another object of this invention is to provide a downhole motor having a new and improved bearing assembly for for operation under high pressure conditions.

Another object of this invention is to provide a downhole motor having a new and improved bearing assembly for high pressure operation which includes means to unload the bearings to increase bearing wear life.

Still another object of this invention is to provide a downhole motor having a bearing assembly for use in connection with downhole motors for high pressure, high speed operation in which the pressure of the fluid operating the motor is applied to unload the bearings to increase wear life.

Other objects of this invention will come apparent from time to time throughout the specification and claims as hereinafter related.

The above stated objects and other objects of the invention are accomplished by a downhole motor and bearing assembly which has tubular housing with an inlet and outlet for flow of drilling fluid. A stator is supported in the housing and a rotor is supported for rotary movement in the stator. An open tubular shaft is connected to the rotor for rotary movement in the housing. The bearing assembly has bearing members in the housing in fixed spaced relation for carrying downward and upward longitudinal thrust loads. Since the motor is designed for high pressure operation, conventional bearings tend to wear out rapidly. In this motor and bearing assembly, the pressure of drilling fluid passing through the motor is bled into the down hole side of the bearings where the pressure is applied against an upset on the bearing shaft having an exposed area on the lower side sufficient to produce an upward thrust completely offsetting the downward thrust produced by the pressure drop across the drill bit. The pressure balanced bearing assembly is operable in combination with any motor operating on flow of fluid, including Moineau motors, turbodrills, etc.

DESCRIPTION OF THE PREFERRED EMBODIMENT

Figure 1:
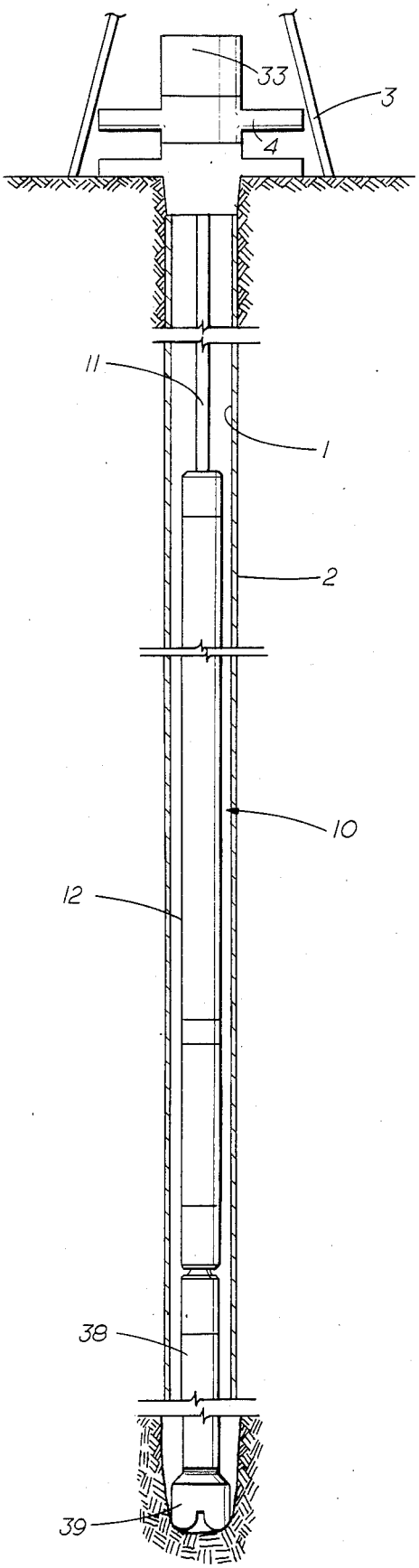
FIG. 1 is a view diagrammatically showing a downhole motor and bearing assembly in position for earth drilling with the well bore shown in section and having a bearing structure illustrating a preferred embodiment of this invention.
Figure 2:
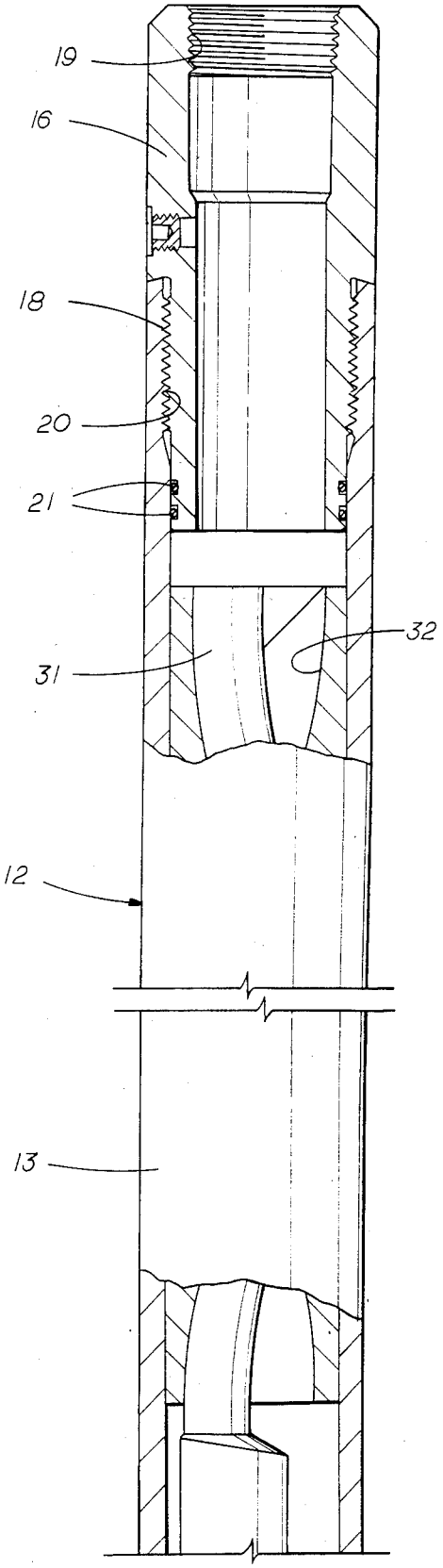
FIGS. 2, 3, 4, and 5 taken together constitute a longitudinal sectional view showing details of the bearing assembly and its relation to the rotary shaft which carries the drill bit.
Figure 3:
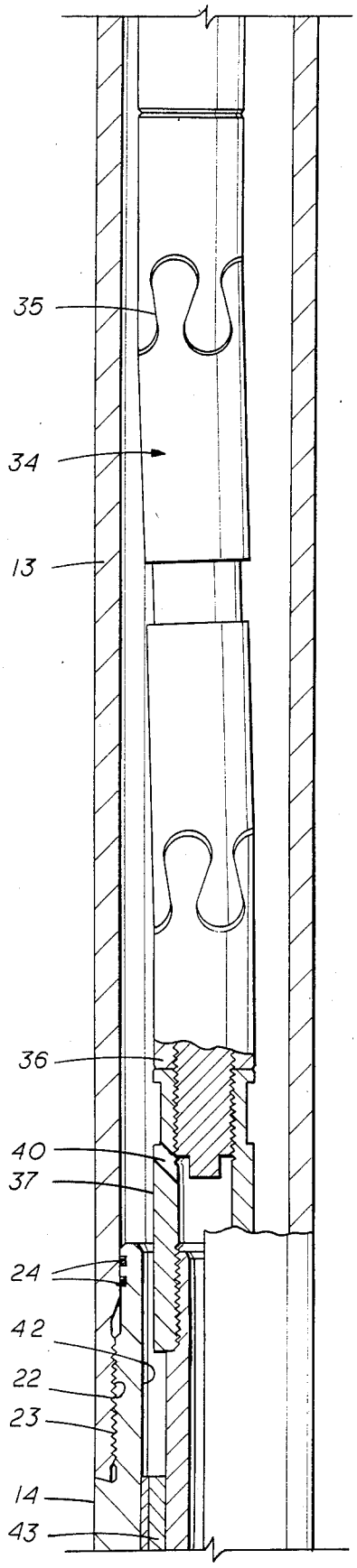
Figure 4:
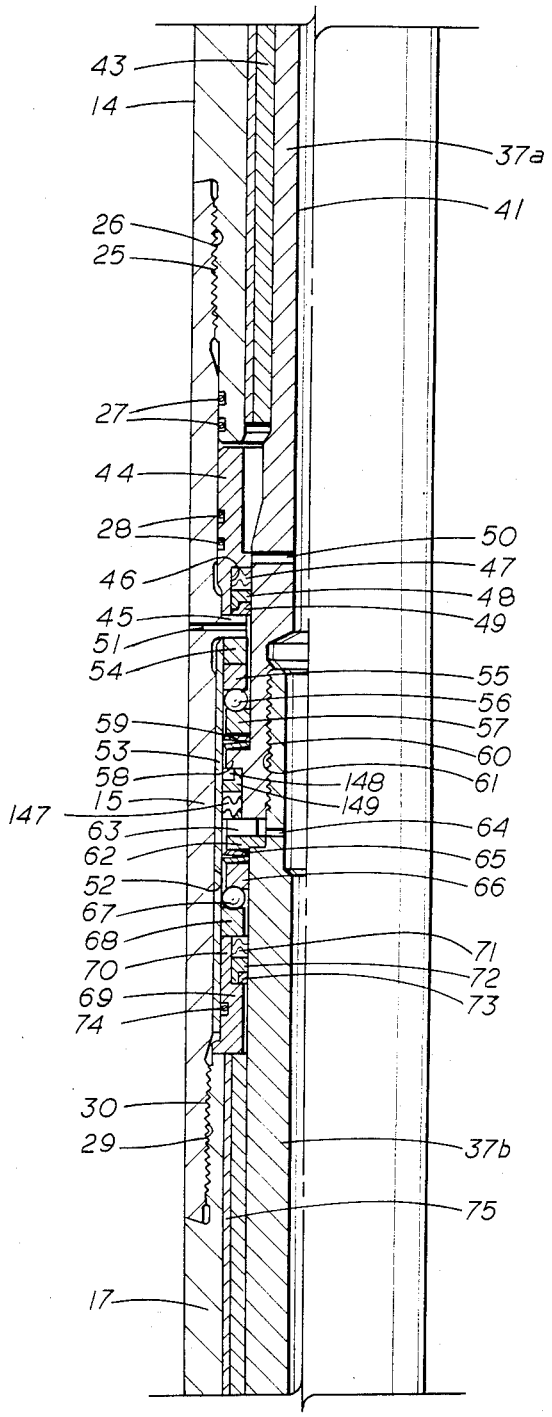
Figure 5:
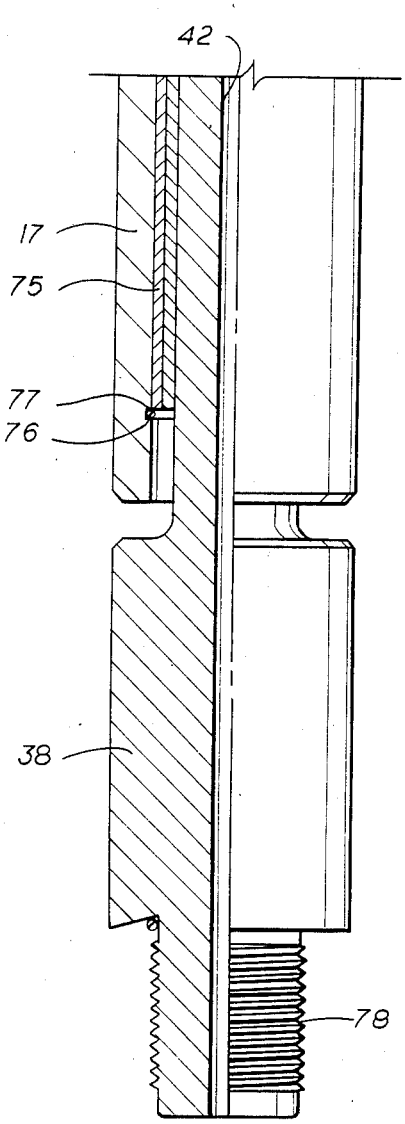
Figure 6:
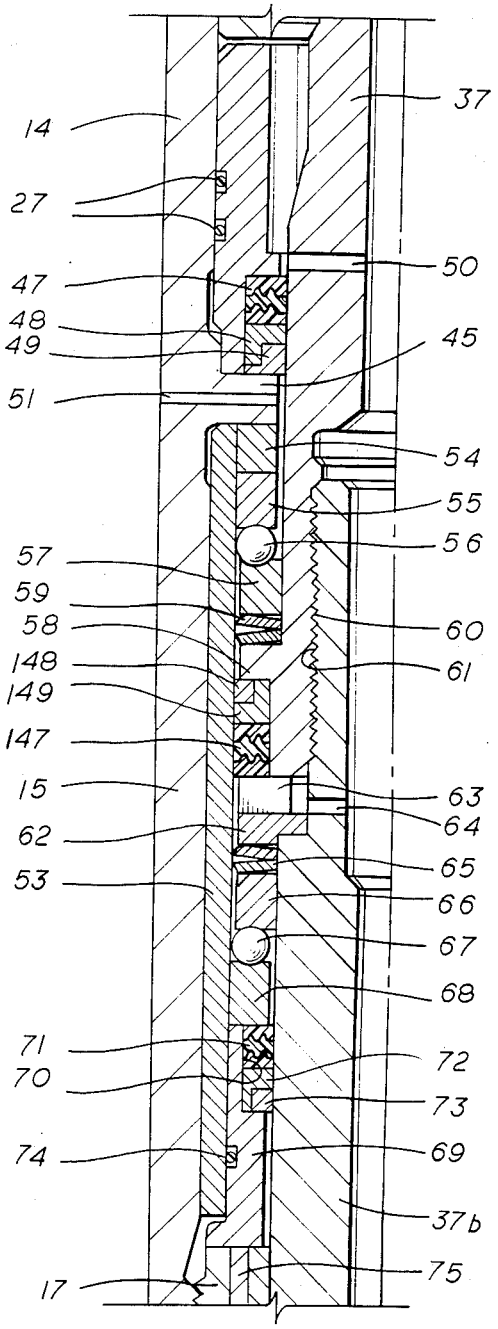
FIG. 6 is a somewhat enlarged detail sectional view of the arrangement for unloading the bearings for high pressure operation.

Referring to the drawings by numerals of reference, and more particularly to FIG. 1 here is shown a vertical section through a borehole 1 in the earth, with a casing 2 in place, and a drill rig 3 positioned at the surface. A downhole motor assembly 10 is supported on the lower end of a string of drill pipe 11, extending from the rig 3, which conducts drilling fluid through the motor assembly and into the bore hole. The structure of the motor assembly 10 and associated bearing housing will be described in detail below.

In the embodiment shown in FIGS. 2–5, motor assembly 10 is a positive displacement motor such as a Moineau type fluid motor having a helicoid progressing cavity. It is obvious that the improved bearing assembly can be used with other fluid-operated downhole motors such as turbodrills and the like.

In the motor assembly 10 of FIGS. 2–5, there is a housing assembly 12 having a motor housing section 13 (FIGS. 2 and 3), a two-part bearing housing section 14, 15, an upper connection sub 16, and a drill sub 17. Upper connection sub 16 has male threads 18 at one end for connection to the upper end of motor sub 13. The upper end of connection sub 15 has female pipe threads 19 for connection to the pipe string 11. The upper end of motor housing 13 has female threads 20 for connection to the connection sub 16. O-rings 21 seal around connection sub 16 against leakage.

The lower end of motor housing 13 has female threads 22 for connection to male threads 23 on the upper end of upper bearing housing 14. O-rings 24 seal against leakage. The lower end of bearing housing portion 14 has male threads 25 which forms a threaded joint with female threads 26 on the upper end of bearing housing portion 15. O-rings 27 and 28 seal against leakage. The lower end of bearing housing portion 15 has female threads 29 which make a joint with male threads 30 on the upper end of drill sub 17. The several threaded joints so far described provide for the break down of the housing into a plurality of sections to facilitate assembly of the working parts therein.

A rotatable helicoidal rotor 31 is positioned in stator 32 and rotated in response to drilling fluid flowing therethrough. As noted, the motor which is illustrated is a positive displacement fluid motor of a well known commercially available type. Obviously, other types of fluid operated motors can be used, especially fluid turbine operated motors, sometimes known as turbodrills. The rotor 31 is driven by the downward flow of drilling fluid which is supplied to the drill pipe 11 by a pump 33. Pump 33, shown schematically, is located on a conventional drilling rig 3 having a rotary table 4 which rotates pipe 11 in the drill hole. Pipe 11 is supported by drilling lines of the drill rig.

The drilling fluid flows through the apparatus in a downward direction through a connecting rod housing section which encloses connecting rod assembly 34 which is connected by a first universal joint 35 to the lower end of rotor 31 and by a second universal joint 36 to the upper end of a drive shaft 37.

The drive shaft 37 extends downwardly through and is rotatably supported in a bearing housing assembly 14 and 15. Drive shaft 37 is hollow in construction, as will be subsequently described, and has a drill bit sub 38 at its lower end for supporting a drill bit 39, preferably a diamond bit for high speed drilling operation without excessive damage or wear.

The drive shaft 37 is tubular in shape and has inlet ports 40 at its upper end. The drilling fluid passes from the connecting rod housing through the inlet ports 40 into the elongated central bore 41 of the drive shaft 37. The fluid passing through the drive shaft 37 exits from the drill bit 39 to flush cuttings from the bore hole 1 and to further cool the bit.

During operation of the fluid motor 10, the lower end of rotor 31 has an eccentric motion which is transmitted to drive shaft 37 by the universal connecting rod assembly 34. Drive shaft 37 therefore revolves about a fixed axis within the outer housing structure 14 and 15 of the bearing assembly. The drive shaft 37 is supported within the housing by bearings described below and shown more fully in FIGS. 3–5 which constitutes a major novel feature of the preferred embodiment of the invention.

Bearing housing 14 has an internal cylindrical bore 42 in which there is positioned a two-part marine bearing 43 through which the upper portion 37*a* of drive shaft 37 extends. A retention sleeve 44 is positioned just below the marine bearing 43 between the lower end of housing portion 14 and an inwardly extending peripheral flange 45 in housing portion 15. Sleeve 44 has a counterbore 46 in which there is supported a seal assembly comprising packing seal 47 and seal rings 48 and 49 pressed tightly against the flange 45 and the rotating surface of shaft portion 37*a*. A passage 50 opens through the wall of drive shaft 37 into the space above the seal assembly. A passage 51 opens through the flange 45 to the exterior of housing portion 15.

Housing portion 15 has a bore 52 below the flange 45 extending to the lower end of the housing. A sleeve 53 fits the bore 52 and supports various bearing components. Bearing shoulder ring 54 is supported on sleeve 53 against the underside of flange 45. The upper race 55 for ball bearings 56 is supported on sleeve 53 against shoulder ring 54 secured against rotation relative to the housing. The lower race 57 for ball bearings 56 is rotatable with shaft member 37*a*. A flange or upset 58 on shaft member 37*a* supports a pair of Belville springs 59 which press the race 57 against bearings 56. Immediately below the shaft upset 58 there is a seal assembly comprising packing seal 147 and seal rings 148 and 149 pressed tightly against shaft upset 58 and the rotating surface of shaft portion 37*a*.

The lower end of shaft portion 37*a* has female threads 60 which form a threaded connection with male threads 61 on the upper end of shaft portion 37*b*. A ring member 62 is secured between the lower end of shaft portion 37*a* and the upper end of shaft portion 37*b* in the threaded connection and has a plurality of slots spaced radially therearound and open to openings 64 from passage 42 in the drive shaft.

Below the ring 62, are a pair of Bellville springs 65 which press against upper bearing race member 66 for ball bearings 67. Bearing race member 66 is supported for rotation with the shaft member 37*b*. The lower bearing race member 68 for ball bearings 67 is supported on the sleeve 53 and is stationary with the housing. A bearing back-up ring 69 is supported between the bearing race member 68 and the upper end of the drill sub housing 17. Back-up ring 69 has a counter bore 70 in which there is supported a seal assembly comprising packing seal 71 and seal rings 72 and 73 pressed tightly against the shoulder on the back-upring and the rotating surface of shaft portion 37*b*. O-ring 74 seals back-up ring 69 against leakage.

The drill sub housing 17 is connected by a tight threaded connection to housing portion 15 and secures back-up ring 69 tightly in place. Housing 17 is also a continuation of the bearing housing assembly and has an internal cylindrical bore in which there is positioned a two-part marine bearing 75 through which the lower portion 37*b* of drive shaft 37 extends. A snap ring 76 in a groove 77 abuts the lower end of maring bearing 75 to secure the same in place. The lower end of drill sub 38 has male threads 78 for connection to a crossover sub supporting the drill bit 39.

OPERATION

In operation, the motor-bearing pack assembly 10 is mounted on the drill pipe 11 for drilling operation in the well bore 2, which is shown as a cased well for at least part of its depth. Drilling mud (or other drilling fluid) is pumped through the drill pipe 11 into the top of housing 12 and through the motor and bearing sections and out through the drill bit. The flow of the drilling mud (or other drilling fluid) through the motor section causes it to rotate at high speed to turn the drill bit 39 for drilling the hole. As previously noted, the apparatus has been described with a Moineau type positive displacement motor utilizing the novel bearing pack. Other fluid-operated motors, such as turbines and the like, are equally usable with the new and improved bearing pack described above.

As previously noted, the bearing pack includes two sets of bearings, i.e., longitudinal thrust bearings 56 and 67 and radial bearings 43 and 75. The radial bearings do not carry very high loads and are not much of a design problem. The marine bearings used herein have proven satisfactory for both low pressure and high pressure operation. The longitudinal thrust bearings, on the other hand, are a serious problem under high pressure operation.

When the motor is operated by mud (or other drilling fluid) pumped therethrough the downward forces in the motor are the sum of rotor weight, $W_R$, and hydraulic downthrust, $F_H$. The upward balancing force is bit weight, W, i.e. the reactive force of the drill bit on the bottom of the hole. The difference between total downward forces and the upward force of bit weight represents the load carried by the longitudinal thrust bearings, $F_B$, as follows: $F_B=F_H+W_R-W$. At low pressure operation, a typical bearing load may be in the range from 150–1000 psi. At high pressure operation the bearing load may be 10,000 psi. or more and may reduce bearing life from a normal 200 hours to less than one hour.

The hydraulic down thrust, $F_H$, is expressed by the formula:

$$F_H=F_{HR}+F_{HB}$$

where $F_{HR}$=hydraulic downthrust due to motor pressue drop.

$F_{HB}$=hydraulic downthrust due to bit pressure drop.

where $$F_{HR}=P_m\times A_R \text{ (lbs.)}$$

$$F_{HB}=P_B\times A_s \text{ (lbs.)}$$

$P_m$=pressure drop across motor (psi)

$P_b$=pressure drop across bit (psi)

$A_R$=effective area of rotor (sq.in.)

$A_s$=effective area of rotating seal. (sq.in.)

When this formula is applied to high pressure operation, e.g., 10,000 psi, bearing loads of 20,000 lbs. and higher are encountered in small diameter drills which reduces the life of the bearings below the limits of commercial practicality.

In this improved bearing assembly, the pressure of the drilling mud is used to balance the load on the bearings as will be described more fully below. The bearing pack housing 15 is vented to ambient or borehole pressure by passage 51 just above the shaft upset 58 and upper bearings 56. The pressure of drilling mud flowing through the motor shaft is bled through passage 64 and slots 63 to the space just below the shaft upset 58 and above the lower bearings 67. The fluid pressure below shaft upset 58 and seal 147, 148 and 149 operates against a larger area that the area exposed to the downward pressure of fluid flowing through the motor. The difference in areas against which the drilling fluid pressure operates is adjusted to substantially balance the load on the thrust bearings at the selected high operating pressure.

The hydraulic downthrust produced by the bit pressure drop, $F_{HB}$ is:

$$F_{HB}=P_b(A_1-A_2+A_3)$$

where $P_b$=pressure drop across bit (psi)

$A_1$=upper shaft seal area (sq.in.) (part 47)

$A_2$=upset seal area (sq.in.) (part 147)

$A_3$=lower seal area (sq.in.) (part 71)

The seal areas A are calculated as follows:

$$A=Pi/4\times d^2$$

where d is the diameter of the seal at the sliding interface. The hydraulic downthrust $F_{HB}$ can also be expressed as:

$$F_{HB}=P_b\times A_s$$

where $A_s$ is the effective seal area (sq. in.) defined as:

$$A_s=A_1-A_2+A_3$$

The bit pressure drop, $P_b$ is:

$$P_b=P_i-P_A$$

where $P_i$=pressure inside bearing pack (psi)

$P_A$=pressure outside motor or bearing pack.

From the above equations, it is seen that the hydraulic downthrust caused by the bit pressure drop is zero ($F_{HB}=0$) when $A_s=0$; which occurs when $A_2=A_1+A_3$ In this case, the hydraulic downthrust on the rotor is produced only by the pressure drop across the motor (from the equation: $F_H=F_{HR}+F_{HB}$), i.e., $F_H=P_m\times A_R$. The hydraulic downthrust therefore equals $F_H=P_m\times A_R$ and the bearing load equals $F_B=P_m\times A_R+W_R-W$.

All of the load on the bearing is removed ($F_B=0$) when the effective seal area $A_s$ is adjusted so that:

$$P_B\times A_x=P_m\times A_R+W_R-W$$

or when $A_s$ equals $$A_s=(P_m\times A_R+W_R-W)/P_b$$

This condition completely unloads the thrust bearing. There should be essentially no thrust bearing wear when this condition exists.

A motor-bearing assembly under development having 2½ in. diameter motor housing and bit had the following dimensions:

$P_m$=625 psi.

$P_B$=10,000 psi.

$D_1$=1.75 in. (shaft diameter)

$D_2$=2.50 in. (upset diameter)

$W_R$=40 lbs.

W=2,000 to 5,000 lbs.

The seal areas are calculated as follows:

$A_1=Pi/4\times(1.75)^2=2.405$ sq. in.

$A_2=Pi/4\times(2.50)^2=4.909$ sq. in.

The effective seal area, $A_s$, is:

$A_s=2\times2.405-4.909=-0.098$ sq. in.

The load on the bearing produced by the bit pressure drop therefore is:

$F_{HB}=10{,}000\times(-0.098)=-980$ lbs.

The negative result means that the shaft is pushed upward and loads the upper bearing by 980 lbs.

This −980 lbs. hydraulic thrust for the balanced load bearing pack motor compares to a hydraulic downthrust of 21,950 lbs. for a conventional unbalanced bearing pack operated at 10,000 psi.

The field results in this motor-bearing pack design conform to the theoretical calculations. The bearings have a wear life of about 200 hours as compared to 0.81 hour for a motor having an unbalanced bearing pack.

While this invention has been described fully and completely with special emphasis upon several preferred embodiments it shuld be understood that within the scope of the appended claims the invention may be practiced otherwise than as specifically described herein.

I claim:

1. A bearing assembly for assembly on a fluid-operated downhole motor on the fluid outlet end therefrom comprising a tubular housing having an inlet and an outlet for flow of fluid there through, a stator supported in a fixed position in said housing, a rotor supported for rotary movement in said stator, said assembly comprising a bearing housing adapted to be removably secured on the outlet end of said motor housing, a shaft for supporting a drill bit and adapted to be connected to said rotor and supported for rotary movement in said bearing housing, said housing being operable to receive drilling fluid under pressure flowing from said motor for discharge there through into the borehole, bearing means cooperable with said shaft and said bearing housing to carry a longitudinally downward thrust load of said shaft, and hydraulically operated means positioned on the fluid inlet side of said bearing housing relative to said bearing means, including an opening through the wall of said bearing housing into the borehole and means exposed to the drilling fluid in the housing operable to apply an upward thrust to said shaft substantially counterbalancing part or all of the downward force applied to said bearing assembly by the pressure drop from the inlet side of said bearing means through the wall of said bearing housing into the borehole.

2. A bearing assembly for assembly on a fluid-operated downhole motor on the fluid outlet end therefrom comprising a tubular housing having an inlet and an outlet for flow of fluid there through, a stator supported in a fixed position in said housing, a rotor supported for rotary movement in said stator, said assembly comprising a bearing housing adapted to be removably secured on the outlet end of said motor housing, a hollow shaft for supporting a drill bit and adapted to be connected to said rotor and supported for rotary movement in said bearing housing and operable to receive drilling fluid under pressure flowing from said motor for discharge through said drill bit, bearing means cooperable with said shaft and said bearing housing to carry a longitudinally downward thrust load of said shaft, and hydraulically operated means positioned on the fluid inlet side of said bearing housing relative to said bearing means, including an opening through the wall of said hollow shaft and an opening through the wall of said bearing housing into the borehole and means exposed to the drilling fluid in the housing operable to apply an upward thrust to said shaft substantially counterbalancing part or all of the downward force applied to said bearing assembly by the pressure drop from the inlet side of said bearing means through the wall of said bearing housing into the borehole.

3. A bearing assembly according to claim 2 having upper bearing means cooperable with said shaft and said bearing housing to carry a longitudinally upward thrust load of said shaft, lower bearing means cooperable with said shaft and said bearing housing to carry a longitudinally downward thrust load of said shaft, and said hydraulically operated means applies an upward thrust to said shaft substantially counterbalancing the downward force applied to said lower bearing assembly.

4. A bearing assembly according to claim 3 in which said hydraulic means comprises a seal between said shaft and said housing and operatively engaging said shaft to move the same longitudinally, said shaft having an opening below said seal to apply pressure of drilling fluid to the underside of said seal, and said seal having an effective area exposed to drilling fluid pressure sufficient to apply an upward thrust to said shaft substantially counterbalancing the downward force applied to said lower bearing means.

5. A bearing assembly according to claim 3 in which said shaft has a peripheral upset from the surface thereof, said upper bearing means being cooperable with said shaft and said bearing housing above said shaft upset to carry a longitudinally upward thrust load of said shaft, said lower bearing means cooperable with said shaft and said bearing housing below said shaft upset to carry a longitudinally downward thrust load of said shaft said hydraulic means comprises a seal between said shaft and said housing and operatively engaging said shaft below said upset to move said shaft longitudinally, said shaft having an opening below said seal to apply pressure of drilling fluid to the underside of said seal, and said seal having an effective area exposed to drilling fluid pressure sufficient to apply an upward thrust to said shaft substantially counterbalancing the downward force applied to said lower bearing means.

6. A bearing assembly according to claim 5 in which said bearing housing has an opening in the wall thereof above said shaft upset venting the housing to outside pressure, and a seal between said shaft and said housing above said vent opening.

7. A bearing assembly according to claim 6 in which said bearing housing has an inwardly extending flange above said shaft upset, said bearing housing vent opening being at said flange, said seal above said vent opening being between said shaft and said housing and abutting said flange, said seal below said upset being between said shaft and said housing and engaging said upset to apply an upward hydraulic force thereto.

8. A bearing assembly according to claim 7 further including a seal between said shaft and said housing spaced below said seal adjacent to said upset.

9. A bearing assembly according to claim 8 further radial bearings positioned between said shaft and said housing above upper bearing means and below said lower bearing means.

10. A bearing assembly according to claim 9 in which said radial bearings positioned between said shaft and said housing above upper bearing means and below said lower bearing means are marine bearings.

11. A bearing assembly according to claim 2 in which said bearing means comprises a first bearing race supported in said housing, a second bearing race aligned with said first bearing race and operatively supported on said shaft in fixed spaced relation for rotation therewith, and rolling bearing members positioned in bearing relation with said aligned bearing races.

12. A bearing assembly according to claim 11 in which said bearing members are ball bearings.

13. A bearing assembly according to claim 3 in which said upper bearing means comprises a first bearing race supported in said housing, a second bearing race aligned with said first bearing race and operatively supported on said shaft in fixed spaced relation for rotation therewith, and rolling bearing members positioned in bearing relation with said aligned first and second bearing races, and said lower bearing means comprises a third bearing race supported in said housing, a fourth bearing race aligned with said third bearing race and operatively supported on said shaft in fixed spaced relation for rotation therewith, and rolling bearing members positioned in bearing relation with said aligned third and fourth bearing races.

14. A bearing assembly according to claim 13 in which said bearing members are ball bearings.

15. A bearing assembly according to claim 13 in which said shaft has a peripheral upset from the surface thereof, said upper bearing means being cooperable with said shaft and said bearing housing above said shaft upset to carry a longitudinally upward thrust load of said shaft, said lower bearing means cooperable with said shaft and said bearing housing below said shaft upset to carry a longitudinally downward thrust load of said shaft said hydraulic means comprises a seal between said shaft and said housing and operatively engaing said shaft below said upset to move said shaft longitudinally, said shaft having an opening below said seal to apply pressure of drilling fluid to the underside of said seal, said bearing housing having an inwardly extending flange above said shaft upset, said bearing housing having an opening in the wall thereof at said flange venting the housing to outside pressure, a seal between said shaft and said housing above said vent opening, said seal above said vent opening being between said shaft and said housing and abutting said flange, said seal below said upset being between said shaft and said housing and engaging said upset to apply an upward hydraulic force thereto, a seal between said shaft and said housing spaced below said seal adjacent to said upset, and said seal adjacent to said upset having a size a predetermined amount greater than the outside diameter of said shaft at said seal above said vent opening such that the hydraulic pressure of drilling fluid operating thereon substantially counterbalances the downward force applied to said lower bearing means.

16. A bearing assembly accoring to claim 15 further including radial bearings positioned between said shaft and said housing above upper bearing means and below said lower bearing means.

17. A bearing assembly according to claim 16 in which said radial bearings positioned between said shaft and said housing above upper bearing means and below said lower bearing means are marine bearings.

18. A downhole motor and bearing assembly comprising:

a tubular housing having an inlet and an outlet for flow of fluid there through, a stator supported in a fixed position in said housing, a rotor supported for rotary movement in said stator, a shaft operatively connected to said rotor and supported for rotary movement in said housing, a bearing assembly comprising a bearing housing adapted to be removably secured on the outlet end of said motor housing, a hollow shaft for supporting a drill bit and adapted to be connected to said rotor and supported for rotary movement in said bearing housing and operable to receive drilling fluid under pressure flowing from said motor for discharge through said drill bit, bearing means cooperable with said shaft and said bearing housing to carry a longitudinally downward thrust load of said shaft, and hydraulically operated means positioned on the fluid inlet side of said bearing housing relative to said bearing means, including an opening through the wall of said bearing housing into the borehole and means exposed to the drilling fluid in the housing and operable to apply an upward thrust to said shaft substantially counterbalancing part or all of the downward force applied to said bearing assembly by the pressure drop from the inlet side of said bearing means through the wall of said bearing housing into the borehole.

19. A downhole motor and bearing assembly according to claim 18 having upper bearing means cooperable with said shaft and said bearing housing to carry a longitudinally upward thrust load of said shaft, lower bearing means cooperable with said shaft and said bearing housing to carry a longitudinally downward thrust load of said shaft, and said hydraulically operated means applies an upward thrust to said shaft substantially counterbalancing the downward force applied to said lower bearing assembly.

20. A downhole motor and bearing assembly according to claim 19 in which said hydraulic means comprises a seal between said shaft and said housing and operatively engaging said shaft to move the same longitudinally, said shaft having an opening below said seal to apply pressure of drilling fluid to the underside of said seal, and said seal having an effective area exposed to drilling fluid pressure sufficient to apply an upward thrust to said shaft substantially counterbalancing the downward force applied to said lower bearing means.

21. A downhole motor and bearing assembly according to claim 19 in which said shaft has a peripheral upset from the surface thereof, said upper bearng means being cooperable with said shaft and said bearing housing above said shaft upset to carry a longitudinally upward thrust load of said shaft, said lower bearing means cooperable with said shaft and said bearing housing below said shaft upset to carry a longitudinally downward thrust load of said shaft said hydraulic means comprises a seal between said shaft and said housing and operatively engaging said shaft below said upset to move said shaft longitudinally, said shaft having an opening below said seal to apply pressure of drilling fluid to the underide of said seal, and said seal having an effective area exposed to drilling fluid pressure sufficient to apply an upward thrust to said shaft substantially counterbalancing the downward force applied to said lower bearing means.

22. A downhole motor and bearing assembly according to claim 21 in which said bearing housing has an opening in the wall thereof above said shaft upset venting the housing to outside pressure, and a seal between said shaft and said housing above said vent opening.

23. A downhole motor and bearing assembly according to claim 22 in which said bearing housing has an inwardly extending flange above said shaft upset, said bearing housing vent opening being at said flange, said seal above said vent opening being between said shaft and said housing and abutting said flange, said seal below said upset being between said shaft and said housing and engaging said upset to apply an upward hydraulic force thereto.

24. A downhole motor and bearing assembly according to claim 23 further including a seal between said shaft and said housing spaced below said seal adjacent to said upset.

25. A downhole motor and bearing assembly according to claim 24 further including radial bearings positioned between said shaft and said housing above upper bearing means and below said lower bearing means.

26. A downhole motor and bearing assembly according to claim 25 in which said radial bearings positioned between said shaft and said housing above upper bearing means and below said lower bearing means are marine bearings.

27. A downhole motor and bearing assembly according to claim 18 in which said bearing means comprises a first bearing race supported in said housing, a second bearing race aligned with said first bearing race and operatively supported on said shaft in fixed spaced relation for rotation therewith, and rolling bearing members positioned in bearing relation with said aligned bearing races.

28. A downhole motor and bearing assembly according to claim 27 in which said bearing members are ball bearings.

29. A downhole motor and bearing assembly according to claim 19 in which said upper bearing means comprises a first bearing race supported in said housing, a second bearing race aligned with said first bearing race and operatively supported on said shaft in fixed spaced relation for rotation therewith, and rolling bearing members positioned in bearing relation with said aligned first and second bearing races, and said lower bearing means comprises a third bearing race supported in said housing, a fourth bearing race aligned with said third bearing race and operatively supported on said shaft in fixed spaced relation for rotation therewith, and rolling bearing members positioned in bearing relation with said aligned third and fourth bearing races.

30. A downhole motor and bearing assembly according to claim 29 in which said bearing members are ball bearings.

31. A downhole motor and bearing assembly according to claim 29 in which said shaft has a peripheral upset from the surface thereof, said upper bearing means being cooperable with said shaft and said bearing housing above said shaft upset to carry a longitudinally upward thrust load of said shaft, said lower bearing means cooperable with said shaft and said bearing housing below said shaft upset to carry a longitudinally downward thrust load of said shaft said hydraulic means comprises a seal between said shaft and said housing and operatively engaging said shaft below said upset to move said shaft longitudinally, said shaft having an opening below said seal to apply pressure of drilling fluid to the underside of said seal, said bearing housing having an inwardly extending flange above said shaft upset, said bearing housing having an opening in the wall thereof at said flange venting the housing to outside pressure, a seal between said shaft and said housing above said vent opening, said seal above said vent opening being between said shaft and said housing and abutting said flange, said seal below said upset being between said shaft and said housing and engaging said upset to apply an upward hydraulic force thereto, a seal between said shaft and said housing spaced below said seal adjacent to said upset, and said seal adjacent to said upset having a size a predetermined amount greater than the outside diameter of said shaft at said seal above said vent opening such that the hydraulic pressure of drilling fluid operating thereon substantially counterbalances the downward force applied to said lower bearing means.

32. A downhole motor and bearing assembly according to claim 31 further including radial bearings positioned between said shaft and said housing above upper bearing means and below said lower bearing means.

33. A downhole motor and bearing assembly according to claim 32 in which said radial bearings positioned between said shaft and said housing above upper bearing means and below said lower bearing means are marine bearings.

* * * * *